United States Patent [19]

Lenk et al.

[11] 3,974,973

[45] Aug. 17, 1976

[54] DOFFING DEVICE FOR BOBBIN TUBES OR SPOOLS

[75] Inventors: Erich Lenk; Peter Illg, both of Remscheid, Germany

[73] Assignee: Barmag Barmer Maschinenfabrik Aktiengesellschaft, Wuppertal, Germany

[22] Filed: Aug. 4, 1975

[21] Appl. No.: 601,795

[30] Foreign Application Priority Data

Aug. 9, 1974 Germany ..... 2834363

[52] U.S. Cl. ..... 242/41

[51] Int. Cl.[2] ..... B65H 67/02

[58] Field of Search ..... 242/41, 46.4, 18 DD; 57/52

[56] References Cited

UNITED STATES PATENTS

| | | | |
|---|---|---|---|
| 3,526,369 | 9/1970 | Beckwith, Jr. | 242/46.4 |
| 3,722,807 | 3/1973 | Swinehart | 242/46.4 X |
| 3,807,647 | 4/1974 | Miller | 242/41 X |
| 3,815,836 | 6/1974 | Munnekehoff et al. | 242/46.4 |

*Primary Examiner*—Richard C. Queisser
*Assistant Examiner*—Charles Gorenstein
*Attorney, Agent, or Firm*—Johnston, Keil, Thompson & Shurtleff

[57] ABSTRACT

Ejector mechanisms coaxially mounted about shafts of a winding tube-holding chuck having tube-engaging means releasable upon rotation of the tube relative to the chuck, and the ejector having an ejector head with a concentric tube-engaging surface moveable into contact with the end of a tube and simultaneously imparting rotation to the tube in the tube-releasing direction of rotation.

8 Claims, 6 Drawing Figures

FIG. 1
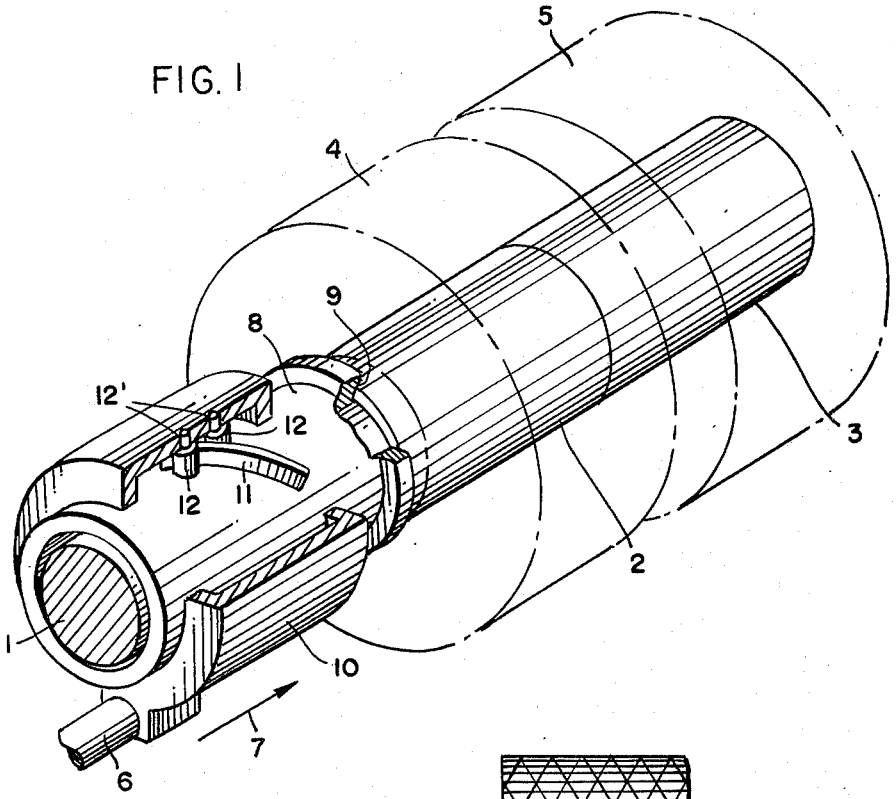
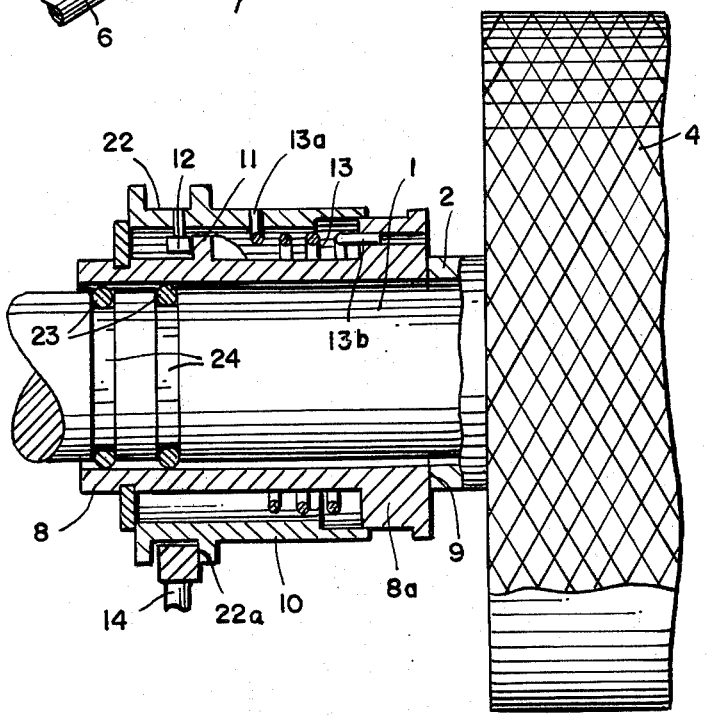
FIG. 2

DOFFING DEVICE FOR BOBBIN TUBES OR SPOOLS

This invention pertains to improvements in ejectors for releasing winding tubes mounted on cantilever-type tube chucks of winding machines. The tube-gripping members of the chuck are known in the art, e.g., German OFFEN. Nos. 2,106,493 and 2,202,009. Tube chucks of this type can be used on winding machines for winding yarns, filaments, bands, ribbons or films. These German OFFEN. indicate that it is necessary to slow down the rotation of the chucks in order to remove the winding tubes.

An ejector mechanism for winding tubes on cantilever-type tube chucks of winding machines is described in British Pat. No. 870,402. This ejector mechanism consists of a rod which can be extended outwardly from the side of the machine frame. The rod carries an ejector head which grips the face of the winding tube closest to the machine frame. Such ejectors are indicated to be of particular advantage when two or more winding tubes are mounted on a given chuck.

This invention pertains to improvements in ejector mechanisms opetatively associated with cantilever-type chucks of winding machines wherein the chucks have releasable gripping members which bear against the inner face of the winding tube and hold the tube tightly on the chuck while it is rotating in the winding direction. Such tube gripping members release their gripping contact with the inner face of the tube when the tube is rotated relative to the chuck in a direction causing the tube-gripping members to loosen their pressure against the winding tube.

This is achieved by utilizing chucks having means for gripping the inner face of the winding tube by members engaging the inner face of the tube or tubes mounted on the chuck in a tube-gripping position. The members are so mounted on the chuck that they release the tubes for removal thereof upon rotation of the tubes relative to the chuck in a tube-releasing direction of rotation. The chucks with which the subject invention is particularly useful are chucks which are supported in cantilever fashion on the winding machine.

The ejector is contiguous to, and preferably is mounted coaxially about, the drive shaft of the rotatable chuck. The ejector embodies mechanisms which provides for movement of the ejector parallel to the shaft, e.g., coaxially about the shaft, toward and away from the machine-contiguous end of a winding tube mounted on the chuck. This ejector carries on its tube-facing end an ejector head having tube-engaging means to engage the aforesaid end of the tube when the ejector head is moved toward said end of the tube. The tube-engaging means may be an annular ring face positioned coaxially about the chuck shaft to engage the end wall of the tube, or it may be a conical or frusto-conical, annular surface into which the aforementioned end of the tube enters and is engaged.

The ejector mechanism further embodies cam means operatively associated with the ejector head to rotate the latter in the aforesaid tube-releasing direction as the tube-engaging means is moved into engagement with the end of the tube. This cam means thereby causes the tube-engaging means and the engaged tube to rotate in the tube-releasing direction.

The cam means preferably is a spiral or a screw thread-like camming surface which engages a follower or followers and provides the simultaneous axial and rotational movement to the ejector head. The spiral camming surface maybe provided by a spiral rib having followers on opposite sides thereof or it maybe a spiral or helical groove or grooves with ball followers in the groove(s).

Another feature of the invention pertains to ejector improvements for winding tube chucks supported in cantilever fashion on bobbin revolvers. Such bobbin revolvers usually carry two winding tube chucks. The revolver moves the chucks in an orbital path between winding position and rest position. In the latter position the winding packages are removed from the chuck and an empty tube or tubes are mounted thereon.

The ejector mechanism perferably is an axially shiftable and rotatable sleeve mounted concentrically about the shaft of each chuck between the machine face and the tube-holding portions of the chuck. This sleeve has a face moveable to and out of engagement with the contiguous end of the winding tube on the chuck. A thrust ring is mounted concentrically about the sleeve. The sleeve and ring are interconnected by a camming device which causes the sleeve to rotate in the tube-releasing direction when the thrust ring is moved linearly toward the winding tube.

For machines having bobbin revolvers as before described, there maybe provided a fork rod with a bifurcated end. As the wound bobbin revolves toward rest position a collar on the outer face of the thrust ring enters and is engaged by the fork. Such engagement is one precluding slippage between the fork and the sleeve.

This fork rod has its opposite end pivotally mounted on a thrust rod moveable in a direction toward and away from the tube-bearing end of the chuck. Axial movement is imparted to the thrust ring from the rod by the fork rod. Such axial movement imparts axial and rotational movement to the sleeve via the camming means.

The forked end of the fork rod orbits about the thrust rod between a home position wherein its open end faces the thrust ring collar for entry of the latter into the forked end prior to stopping of the bobbin revolver. The fork then remains seated in the thrust ring collar when the chuck continues to move to its stop or rest position on the rotating bobbin revolver. It can further pivot as the chuck, with its empty winding tube or tubes now placed thereon, is further moved by the bobbin revolver toward the winding position. A spring is employed to return the now-released fork back to its home position for engagement with the collar of the thrust ring of the next chuck on the bobbin revolver.

The pitch of the camming member advantageously is one wherein the tangent of the pitch angle of the spiral or helical rib groove or the like is smaller than the coefficient of friction between the contacting faces of two winding tubes mounted on the chuck. Further, the thrust ring and sleeve preferably are interconnected by a helical spring positioned therebetween and having its respective ends secured in the sleeve and ring. Such spring exerts a torque force and a linear force, the composite vector of which is parallel to the pitch of the rib, groove or the like of the cam means.

The invention will be appreciated from the following description of preferred embodiments of the invention, which are illustrated in the drawings wherein:

FIG. 1 is a perspective view of a tube chuck with two windings thereon and a first embodiment of the invention of an ejector which is partially broken away;

FIG. 2 is a fragmentary side elevation of a chuck shaft and a winding with a second embodiment of an ejector mechanism shown in diametric cross-section;

Figure 3:
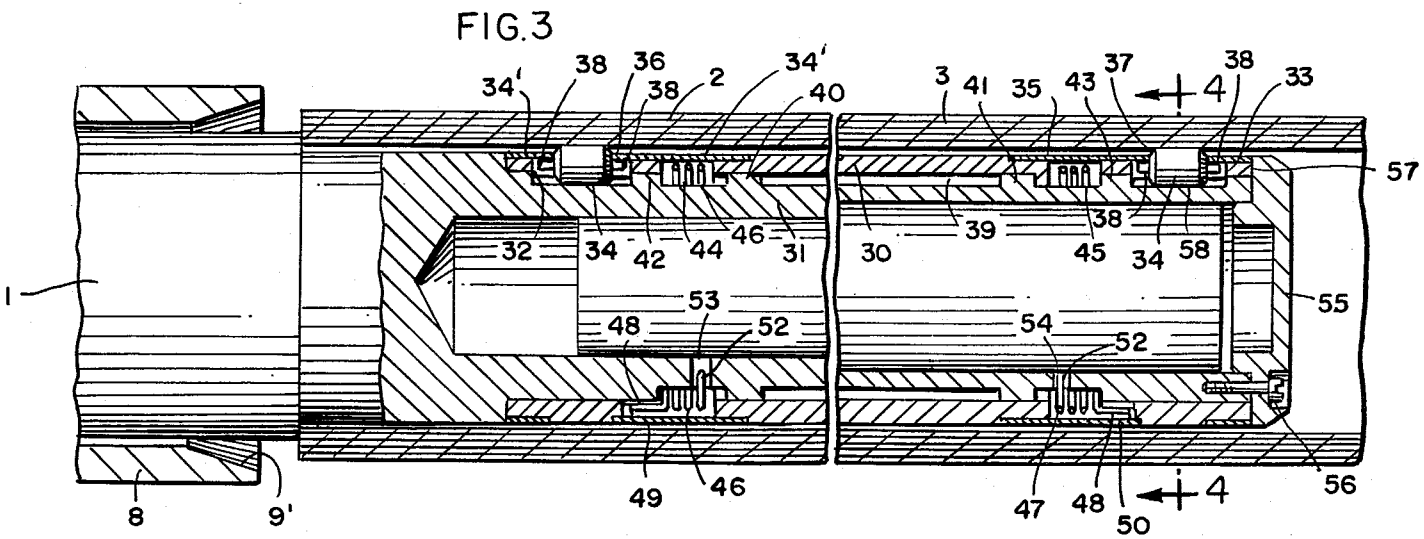
FIG. 3 is a fragmentary cross-section of the tube adjacent end of another embodiment of the ejector mechanism and a chuck with a winding tube mounted thereon as taken on section plane 3—3 of FIG. 4.

Referring to the drawings and particularly to FIGS. 1 and 2, the drive shaft 1 of a chuck described in detail hereinafter rotatable drives a pair of abutting winding tubes 2 and 3 mounted about the chuck. The windings 4 and 5 formed on the tubes maybe windings of yarns, filaments, strips, bands, or films. The shaft 1 and its chuck are supported in cantilever fashion on a machine frame, on a bobbin revolver or the like. Between the machine frame or the revolver and the tube bearing portion on the chuck is an ejector for ejecting wound packages from the chuck. This ejector comprises a reciprocally driven rod 6 projecting from the machine frame 1. When moved in the direction of arrow 7, it ejects the tubes and their windings toward the end of the chuck. The ejector mechanism includes a sleeve 8 mounted coaxially about and in spaced relationship to the chuck shaft 1. This sleeve is moveable axially relative to the shaft 1 into engagement with the ejector-facing end of the winding tube 2. As the sleeve 8 moves axially on the shaft 1 into engagement of its tube-facing, friction surface 9 against the end of the tube 2, the sleeve is also caused to rotate. The axial and rotary motion by the sleeve is imparted through a thrust ring 10, which is positioned coaxially about the sleeve 8. The thrust ring 10 is connected to the rod 6. As it is moved in the direction of the arrow 7 its follower rollers 12 having their shafts 12′ mounted on the thrust ring 10 coact with the helical or spiral cam rib 11 on the sleeve to impart both an axial and rotational movement to the sleeve 11. Thus, when the face 9 of the sleeve 8 engages the end of tube 2, it imparts to the latter an axial push and also a rotational force in a direction which releases the gripping engagement between the chuck and the inner face of the winding tube. An embodiment of the chuck construction is described hereinafter. Thus the winding tubes 2 and 3 become loosely gripped by the chuck and the tubes 2 and 3 with their windings 4 and 5 can be pulled off the free end of the chuck.

Preferably, the sleeve 8 and the thrust ring 10 have positioned therein a coil spring 13. One end 13*a* of the coil spring is mounted in the thrust ring 10 while the other end 13*b* is mounted in the enlarged head portion 8*a* of the sleeve.

This coil spring returns the sleeve 8 axially and rotationally to its normal position after the ejecting function. The return spring 13 has a torsional and compressive strength provided a resultant force action, which is the result from the axial compressive force on the spring and the torsional force action resulting from rotation of the sleeve, in parallel to the pitch angle of the rib 11. With this relationship the spring does not exert pressure against the rib 11 and follower rollers 12.

The ejector mechanism of FIG. 2, as is apparent from the above description, utilizes an ejector mechanism similar to FIG. 1. It differs principally in the connection between the thrust ring 10 and the push rod 6. The ejector mechanism of FIG. 2 may be used in a winder utilizing a bobbin revolver which supports two or more winding chucks. A winder with a bobbin revolver is illustrated diagrammatically in FIG. 5. For more specific details reference made to U.S. application, Ser. No. 456,222.

Figure 5:
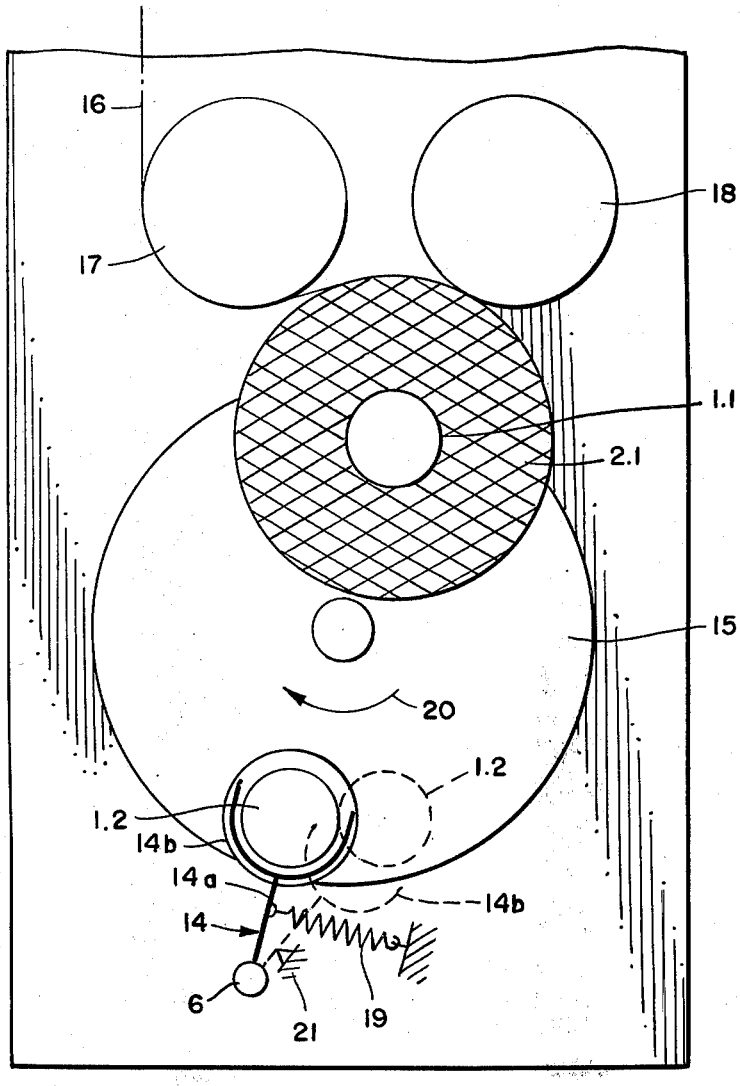
FIG. 5 is a diagrammatic view of a winder having two chucks mounted on a bobbin revolver and a forked member adapted to engage the ejector mechanism associated with each chuck.

The winding mechanism of FIG. 5 includes a spirally grooved traverse roll 17 used per se or in conjunction with a reciprocating traverse guide to impart traversing motion to the yarns, filaments, etc., 16 delivered to the winding chuck 1.1 to form the winding 2.1. The winding chuck 1.1 and the winding 2.1 are shown in winding position. The winding is rotatably driven during the winding operation by the friction drive roll 18.

The winding unit includes a bobbin revolver 15 on which two chuck shafts of the type herein described are supported in cantilever fashion at diametrically opposite sides of the revolver 15. The latter is revolved in direction of the arrow 20.

The winding chuck 1.2 is in rest position wherein the winding tubes with the windings thereon are ejected as hereinafter described.

Referring compositely to FIGS. 2 and 5, the push rod 6 has pivotally mounted on its end a forked member 14 having a shaft 14*a* and a forked end 14*b*. The forked member 14 is normally urged by the tension spring 19 against a stop 21 (the position shown in phantom lines in FIG. 5). As the winding chuck 1.2 is orbited into rest position by the rotation of the bobbin revolver 15, the forked end 14*b* is received by the collar 22 on the thrust ring 10 (FIG. 2). As the chuck 1.2 orbits to rest position as shown in full lines in FIG. 5, forked member 14 is pivoted from the position shown in phantom lines to the position shown in full lines. In the latter position the forked end 14*b* tightly bears against the flange wall 22*a* of the collar 22 to preclude rotation of the thrust ring 10 when the latter is pushed by the rod 6 and forked member 14 in the direction of the arrow 7. For this purpose the contact areas between the collar 22 and the forked end 14*b* each have a high friction surface. When the thrust ring 10 is pushed by the rod 6 and forked member 14, the ejector sleeve 8 is actuated by the spiral rib 11 and follower rollers 12 so that its face 9 contacts the end of the tube 2. The ejector sleeve 8 is moved both axially and rotatably by the spiral rib-follower roller mechanism 11, 12. Return of the ejector sleeve 8 to its home position is accomplished by the spring 13.

An ejector of the type illustrated in FIG. 2 is mounted coaxially about each of the shafts of the tube chucks 1.1 and 1.2 in the manner illustrated in FIG. 2. Each of such shafts is like the shaft 1 of FIG. 2 and each shaft is fitted with O-rings 23 which are seated in annular grooves 24 of the shaft. The O-rings 23 keep the sleeve 8 centered on and spaced from the shaft 1 while the latter is rotating.

Figure 4:
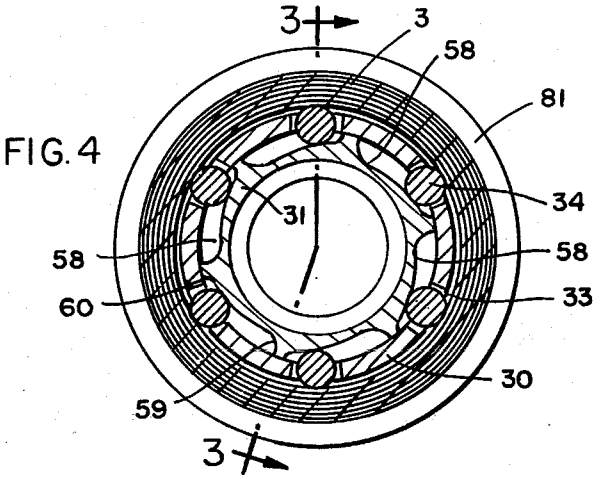
FIG. 4 is a transverse cross-section of the chuck of FIG. 3 taken on section plane 4—4 of FIG. 3.

Referring to FIGS. 3 and 4 the ejector sleeve 8 has at its tube contacting end a tapered, frusto-conical wall 9'. The tube 2 and the tube 3 are removably mounted on the shaft 1 by the chuck mechanism hereinafter described. In the ejecting function, the ejector-facing end of the tube 2 is engaged by the frusto-conical wall 9', which exerts both an axial push and a rotational force in a tube-releasing direction on the tube 2. The axial and rotational force transmitted to the tube 3 by the abutting faces of the respected tubes 2 and 3.

The tube chuck mechanism is of itself known in the art. It embodies a ring sleeve 30 coaxially mounted about the hollow end 31 of the shaft 1. The sleeve 30 is secured on the hollow end 31 of the shaft in a manner precluding movement on the sleeve in the axial direction. The sleeve 30 has two sets of rectangular apertures 32 and 33 about its circumference. Each set of apertures 32 and 33 is composed of circumferenctially spaced apertures respectively arranged in axially spaced rings about the circumference of the sleeve 30. These apertures respectively received tube-engaging rollers 34, which are seated in the apertures 32 and 33 of the sleeve 30. The sleeve 30 has peripheral, thin wall rings or tubes 34' and 35 at axially spaced positions thereon. These rings respectively have apertures 36 and 37 lying over the apertures 32 and 33 of the sleeve 30. The apertures 36 and 37 are the size and shape which allows the radially outer part of the rollers 34 to project therethrough while simultaneously preventing the rollers from falling out of the apertures by restraining the shafts 38 of the rollers 34 by the overlying parts of the tubes 34' and 35 contiguous to the openings 36 and 37 therein.

The sleeve 30 is mounted on the end 31 of the shaft 1 so that it can rotate relatively easy on the shaft. The inner face 39 of the sleeve is supported on the annular ribs or rings 40, 41, 42, and 43, on the shaft end 31. Between the shoulder or ring pairs 40, 42 and 41, 43 the shaft end 31 has annular grooves 44 and 45, in which grooves are mounted in helical springs 46 and 47. The ends 48 of the springs 46 and 47 are mounted in axial slots 49 and 50 in the outer face of the shaft end 31. The other end 52 of each spring is mounted in a radial aperture 53 and 54 in the shaft end 31.

The springs 46 and 47 have their helicies spiraling in opposite directions whereby the springs are pre-tensioned in a manner wherein the sleeve 30 is urged resiliently relative to the shaft end 31 in a manner which produces tightening of the chuck through urging of the rollers 34 against the inner face of the tubes 2 and 3, i.e., in the clockwise direction as viewed in FIG. 4. A cap 55 is mounted by screws 56 on the free end of the hollow shaft end 31 of the winding shaft. Its annular shoulder 57 bears against the end of the sleeve 30 and the ring or tube 35 to preclude axial movement thereof.

The rollers 34 are displaced radially inwardly and outwardly by cam surfaces 58 on the outer face of the shaft end 31. The rollers 34 ride on the cam surfaces 58. Each cam surface 58 has a progressively increasing radius beginning at the side 59 of the cam and extending to the other side 60 of the cam surface. Thus, when the sleeve 30 is rotated relative to the shaft end 31 in a clockwise direction as viewed in FIG. 4, the rollers 34 are pushed radially outwardly relative to the axis of the shaft end 31. Conversely when the sleeve 30 is rotated in a counter-clockwise direction, as viewed in FIG. 4, the rollers 34 are allowed to move radially inwardly relative to the axis of the shaft end 31. The tubes 2 and 3 are gripped by rotating the sleeve 30 in said clockwise direction until the rollers 34 bear tightly against the inner face of the tubes. Conversely the grip of the tubes by the rollers 34 is released when the sleeve 30 is rotated in the counter-clockwise direction.

A technician can remove, usually with some difficulty, the wound packages composed of tubes 2 and 3 and windings 4 and 5 by gripping an exposed end of the tube 2 or 3 and rotating the tube and its winding in a manner causing the tube and the sleeve 30 to rotate in the tube grip-releasing direction, i.e., counter-clockwise as shown in FIG. 4. Rotation of the sleeve in counter-clockwise direction pushes the rollers 34 in counter-clockwise orbit toward the end 59 of cam surfaces 58 to a point where the operator can slide the wound packages off the end of the chuck.

Advantageously, the ejector embodiments herein described perform the operations of axially pushing against the winding tube 2 and through the latter against the winding tube 3 in the axial direction to move the winding tube 2 and 3 a short distance axially along the chuck. Simultaneously, the grip of the chuck rollers on the winding tube are loosened by the rotational motion imparted by the ejector head against the end of the tube 2. This loosens the grip of the chuck of the tubes 2 and 3 enough so that the tubes 2 and 3 and the windings thereon can be removed from the chuck easily and quickly by the technician or by an automated bobbin removal mechanism.

The tube chuck shown in FIGS. 3 and 4 constitutes an illustrative embodiment of some such type of chuck. Other chuck mechanisms for obtaining the same type of gripping winding tubes are known in the art and can be substituted for the embodiment of FIGS. 3 and 4. In this respect, attention is directed to the aforementioned German OFFEN. Accordingly, the embodiments of the ejectors described herein are not restricted to use in combination with tube chucks of the type shown in FIGS. 3 and 4 but can be used on all other types of tube chucks which utilize the same basic principles of gripping of winding tubes on the chuck by rotational action to attain gripping and release of the winding tubes.

Figure 6:
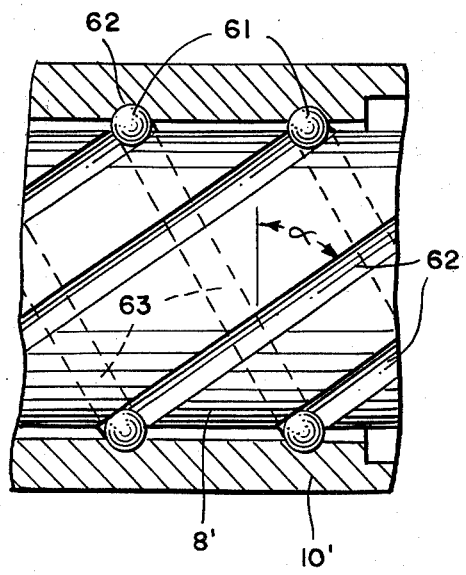
FIG. 6 is a fragmentary section of another embodiment of a cam device used to interconnect the axially moveable and pivotable sleeve by axial movement of the thrust ring.

Another embodiment of the amounting of the thrust ring on the ejector sleeve is shown in FIG. 6, wherein the embodiment is shown in fragmentary view. The ejector sleeve 8' corresponds in shape and configuration to the ejector sleeve 8 of FIGS. 1 and 2, and the thrust ring 10' correspond in structure to the thrust ring 10 of FIGS. 1 and 2. In the embodiment of FIG. 6, however, a spiral groove and ball mechanism is used to impart axial and rotational movement to the ejector sleeve 8' by axial movement of the thrust ring 10'. The thrust ring 10' is supported coaxially about in an annularly spaced relationship to the ejector sleeve 8' by a plurality of ball bearings 61 seated in helical or spiral grooves 62 in the outer face of the ejector sleeve 8'. The ball bearings 61 are seated in spherical seats 62 in the inner face of the thrust ring 10*a* or in cross spiral grooves 63 of the opposite hand to the grooves of 62 and provided in the inner face of the thrust ring 10'. Thus, when the thrust ring 10' is moved axially, an axial and rotational movement is imparted through the ball bearings 61 to the ejector sleeve 8'. This type of mechanism is used in threaded roll spindles. See for example British Pat. No. 1,231,748.

The ball bearing, spiral groove connection of the thread roll spindle type between the thrust ring 10' and the ejector sleeve 8' offers the advantage of low friction losses. The pitch angle $\alpha$ of the spiral thread groove 62 is one in which its tangent is less than the coefficient of friction between the two abutting faces of the tubes 2 and 3. The tangent is also smaller than the coefficient of friction between the tube-engaging surface 9 or 9' of the ejector sleeve and the face of the tube which is contacted thereby. Such pitch angle ensures that axial movement of the ejector sleeve is always accompanied by a torque action imparted to the tube 2. This avoids violent ejection of the tubes by sudden release of the gripping members of the chuck and consequent damage to the tubes, the tube chucks, or the windings thereon. A return spring like that of the helical spring 13 in FIG. 2, which is used on an ejector with the ball bearing-spiral groove mechanism of FIG. 6, is designed so that its result in force action, which is the composite resultant from the axial compressive force action on the spring and the torsion force on the spring result from rotation of the ejector sleeve 8' relative to the thrust ring 10', is parallel to the spiral thread groove 62 so that pressure between the spiral thread groove 62 and the ball bearings is not exerted by the spring.

The tangent of the pitch angle of the spiral cam members, e.g., the rib 11 or the grooves 62, should be smaller than the sum of the coefficient of friction between the cam member and is follower or followers, e.g., the rollers 12 or ball bearings 61 plus the coefficient of friction between the two abutting faces of the tubes 2 and 3. This tangent should be smaller to the same extent than the sum of the aforementioned coefficient of friction of the camming members, the coefficient of friction between the two abutting tube faces and the coefficient of the friction between the end of the tube 2 and the contact friction surface of the ejector sleeve. This relationship between the tangent and the pitch angle and the aforementioned sums of the coefficient's affliction, ensures that rotation of both of the tubes 2 and 3 on the chuck in the tube-releasing direction always occurs during the ejection step.

The invention thus provides ejectors for ejecting tubes held releasably on chucks of the type before described. The ejector mechanisms herein described have relatively simple construction and avoid the disadvantage of having to position the chuck very accurately in a preset position for the ejecting function in order that the ejector properly contact the face of the winding tube. The principles on which the invention is based, particularly with the aforedescribed thrust ring-ejector sleeve combinations, ensures constant and precise positioning of the tube-contacting face of the ejector sleeve with respect to the winding tube to be ejected, and allows the thrust ring to be sufficiently large so that it can be positioned without difficulty in the area in which the ejector is to be operated. The axial and rotational force imparted to the winding tubes by the ejector mechanism avoids the disadvantage that the ejector mechanism might apply a force in the axial direction only and without applying the torque necessary to release the tube or tubes on the chuck. The aforesaid relationship between the tangent of the pitch angle and the sums of the coefficient of the friction are particularly advantageous in this respect. Sudden ejection of the winding tubes by application thereto of only a force in the axial direction could result in a sudden release of the tube or tubes on the chuck-resulting in damage to the tube chuck, the tube or the winding thereon. The problem of sudden ejection is particularly acute when two or more winding tubes are mounted on one chuck.

The invention is hereby claimed as follows:

1. An ejector mechanism for ejecting winding tubes from cantilevered winding machine chucks having means for gripping the winding tubes, said means having members engaging the inner face of tube in tube-gripping position and releasing the tubes for removal thereof upon rotation of the tubes relative to the chuck in a tube-releasing direction of rotation, said mechanism comprising a chuck rotatably supported on a winding machine with its chuck shaft cantilevered on said machine, an ejector actuator contiguous to said shaft and adapted for linear movement of said ejector actuator parallel to said shaft, an ejector head with tube-engaging means thereon to engage an end of said tube when said head is moved by said acutator toward said end of said tube, and cam means operatively associated with said ejector actuator and said ejector head to move said ejector head toward a tube on said chuck and to rotate said ejector head in said tube-releasing direction of rotation, as said tube-engaging means of said ejector head is moved into engagement with said end of said tube, thereby rotating said tube on said chuck in said tube-releasing direction as said tube is pushed axially on said chuck by said ejector head.

2. An ejector mechanism as claimed in claim 1, said ejector head being a cylindrical sleeve mounted slidably, rotatably and coaxially about said shaft with a tube-engaging surface on the tube-facing end of said sleeve, said actuator embodying a thrust ring positioned coaxially about said sleeve and movable in the axial direction, and said cam means embodying spiral cam surface means and follower means interconnecting said sleeve and said thrust ring to provide the movement of said tube engaging means into contact with said end of said tube and the simultaneous rotation thereof in the tube-releasing direction of rotation upon axial movement of said thrust ring.

3. An ejector mechanism as claimed in claim 2 mounted on each chuck shaft of a plurality of chucks supported on revolver means adapted to revolve said chucks orbitally into a winding position and a rest position, and linearly movable means with thrust ring-gripping means to grip the thrust ring of the ejector mechanism of the chuck in rest position to impart axial movement of said thrust ring toward the chuck while precluding rotation of said thrust ring.

4. An ejector mechanism as claimed in claim 3 wherein said movable gripping means embodies a pivotable member having a forked end adapted to frictionally engage said thrust ring, said member being pivotable about an axis parallel with the longitudinal axis of the thrust ring with the forked end of said member being orbitally movable from a first position in which the thrust ring enters the forked end as its chuck is orbited by said revolver means toward said rest position, then to said rest position with the thrust ring frictionally held in said forked end, and then to a position allowing said thrust ring to leave the forked end as its chuck is orbited from rest position toward said winding position, and spring means connected to said member for returning said forked end to said first position after the thrust ring as left said forked end.

5. An ejector mechanism as claimed in claim 2, said spiral cam surface means and said follower means comprising spiral grooves in the outer wall of said sleeve and ball bearings between said sleeve and said thrust ring and seated in said grooves.

6. An ejector mechanism as claimed in claim 2, two winding tubes mounted on said chuck with contiguous ends of the tubes in abutting relationship, the tangent of the pitch angle of said spiral cam surface means being less than the coefficient of friction between the abutting, contiguous ends of said tubes.

7. An ejector mechanism as claimed in claim 2, wherein said tube-engaging surface is a frusto-conical surface in the tube-facing end of said cylindrical sleeve.

8. An ejector mechanism as claimed in claim 2, compressible and twistable return spring means connecting said sleeve and said thrust ring for returning said sleeve after disengagement of its tube-engaging surface from said winding tube, and the direction of force of the compressed and twisted spring means being parallel to said spiral cam surface means.

* * * * *